US006755168B2

(12) United States Patent
Schneider et al.

(10) Patent No.: US 6,755,168 B2
(45) Date of Patent: Jun. 29, 2004

(54) AUTOMATIC DECOMPRESSION DEVICE FOR VALVE-CONTROLLED INTERNAL-COMBUSTION ENGINES

(75) Inventors: Andreas Schneider, Leonberg (DE); Mike Seidel, Oldisleben (DE)

(73) Assignee: Harley Davidson Motor Company Group, Inc., Milwaukee, WI (US)

( * ) Notice: Subject to any disclaimer, the term of this patent is extended or adjusted under 35 U.S.C. 154(b) by 159 days.

(21) Appl. No.: 09/957,694

(22) Filed: Sep. 20, 2001

(65) Prior Publication Data

US 2002/0078915 A1 Jun. 27, 2002

(30) Foreign Application Priority Data

Sep. 23, 2000 (DE) ..... 100 47 255

(51) Int. Cl.[7] ..... F01L 13/08
(52) U.S. Cl. ..... 123/182.1; 123/90.6
(58) Field of Search ..... 123/182.1, 185.4, 123/185.5, 185.6, 90.6, 90.16, 90.33, 90.34

(56) References Cited

U.S. PATENT DOCUMENTS

| | | | | |
|---|---|---|---|---|
| 3,395,689 A | | 8/1968 | Kruse | |
| 4,453,507 A | | 6/1984 | Braun et al. | |
| 4,615,313 A | | 10/1986 | Tsumiyama | |
| 4,648,362 A | | 3/1987 | Kastlunger | |
| 4,651,687 A | | 3/1987 | Yamashita et al. | |
| 4,790,271 A | | 12/1988 | Onda | |
| 4,991,551 A | * | 2/1991 | Terai et al. | 123/198 D |
| 5,065,720 A | | 11/1991 | Nishiyama et al. | |
| 5,150,674 A | | 9/1992 | Gracyalny | |
| 5,582,143 A | * | 12/1996 | Stark et al. | 123/182.1 |
| 5,653,199 A | | 8/1997 | Ishiuchi et al. | |
| 5,687,683 A | | 11/1997 | Knoblauch | |
| 5,816,208 A | * | 10/1998 | Kimura | 123/182.1 |
| 5,943,992 A | | 8/1999 | Kojima et al. | |
| 6,374,792 B1 | * | 4/2002 | Suzuki et al. | 123/182.1 |

FOREIGN PATENT DOCUMENTS

| | | |
|---|---|---|
| DE | 1576262 | 3/1970 |
| DE | 4221394 | 1/1994 |
| DE | 19716830 | 10/1998 |

* cited by examiner

*Primary Examiner*—Willis R. Wolfe
*Assistant Examiner*—Johnny H. Hoang
(74) *Attorney, Agent, or Firm*—Michael Best & Friedrich LLP

(57) ABSTRACT

An automatic decompression device for an internal combustion engine includes a camshaft rotatable about an axis of rotation and having an end face, and a lever coupled to the end face and movable between a first position, wherein the lever is engageable with a valve actuating device to actuate a valve during rotation of the camshaft, and a second position, wherein the lever does not substantially move the valve actuating device. The lever is preferably pivotally coupled to the end face to pivot about a pivot axis that is substantially perpendicular to the axis of rotation of the camshaft. Further preferably, the automatic decompression device further includes a spring between the end face and the lever to bias the lever toward the first position. In a highly preferred embodiment, the end face of the camshaft includes a slot and the lever is at least partially retained within the slot.

19 Claims, 6 Drawing Sheets

AUTOMATIC DECOMPRESSION DEVICE FOR VALVE-CONTROLLED INTERNAL-COMBUSTION ENGINES

FIELD OF THE INVENTION

The invention relates to an automatic decompression device for valve-controlled internal-combustion engines, and more specifically to an automatic decompression device for use in the internal-combustion engine of a motorcycle.

BACKGROUND OF THE INVENTION

One example of an automatic decompression device is disclosed in U.S. Pat. No. 5,687,683. The device includes a decompression lever pivotally mounted on a camshaft and having a pivot axis that is situated at a right angle to the rotational axis of the camshaft. The decompression lever has two lever arms configured such that the center of gravity of the lever is fixed on the rotational axis of the camshaft or immediately adjacent thereto.

The decompression lever is acted upon by a spring member, so that below a specified rotational speed of the camshaft, the decompression lever is kept in a first position and engages a valve. In this first position, automatic decompression is achieved by suitable actuation of the valve as the camshaft rotates. If a predetermined rotational speed of the camshaft is exceeded, the decompression lever is pivoted against the spring force into a second position as a result of the action of centrifugal forces. In the second position, there is no longer an operative connection between the decompression lever and the valve, and therefore no automatic decompression.

As is evident from the drawings of the '683 Patent, the decompression lever is coupled to the camshaft in between the ends of the camshaft and in the region of a cam. To achieve this configuration, the camshaft and the cams are provided with corresponding recesses that are adapted to receive the lever.

SUMMARY OF THE INVENTION

The recesses provided in the camshaft and cams of the prior art assembly can result in the weakening of the camshaft and the cams, which are both highly stressed components of the internal combustion engine. The present invention overcomes this problem and provides an improved automatic decompression device for valve-controlled internal-combustion engines in which the decompression lever is fastened or mounted in such a way that the strength and rigidity of the cams and the camshaft are not adversely affected. More specifically, the decompression lever is mounted on an end face of the camshaft such that neither the cams nor the camshaft have their strength or rigidity adversely affected. With this design, the number of manufacturing steps is reduced and assembly is facilitated.

More specifically, the invention provides an automatic decompression device for an internal combustion engine. The device includes a camshaft rotatable about an axis of rotation and having an end face, and a lever coupled to the end face and movable between a first position, wherein the lever is engageable with a valve actuating device to actuate a valve during rotation of the camshaft, and a second position, wherein the lever does not substantially move the valve actuating device.

In one aspect of the invention, the lever is pivotally coupled to the end face to pivot about a pivot axis that is substantially perpendicular to the axis of rotation of the camshaft. In another aspect of the invention, the automatic decompression device further includes a spring between the end face and the lever to bias the lever toward the first position. In yet another aspect of the invention, the end face of the camshaft includes a slot and the lever is at least partially retained within the slot.

In yet another aspect of the invention, the automatic decompression device further includes a cam mounted adjacent the end face of the camshaft. The cam has an end face that is engaged by the lever when the lever is in the second position. Preferably, the end face of the cam includes a groove having therein a stop, and the lever includes an arm that engages the stop when the lever is in the second position. Further preferably, the engagement between the stop and the arm is a line contact to substantially prevent the arm from sticking or binding in the groove.

Other features and advantages of the invention will become apparent to those skilled in the art upon review of the following detailed description, claims, and drawings.

Figure 1:
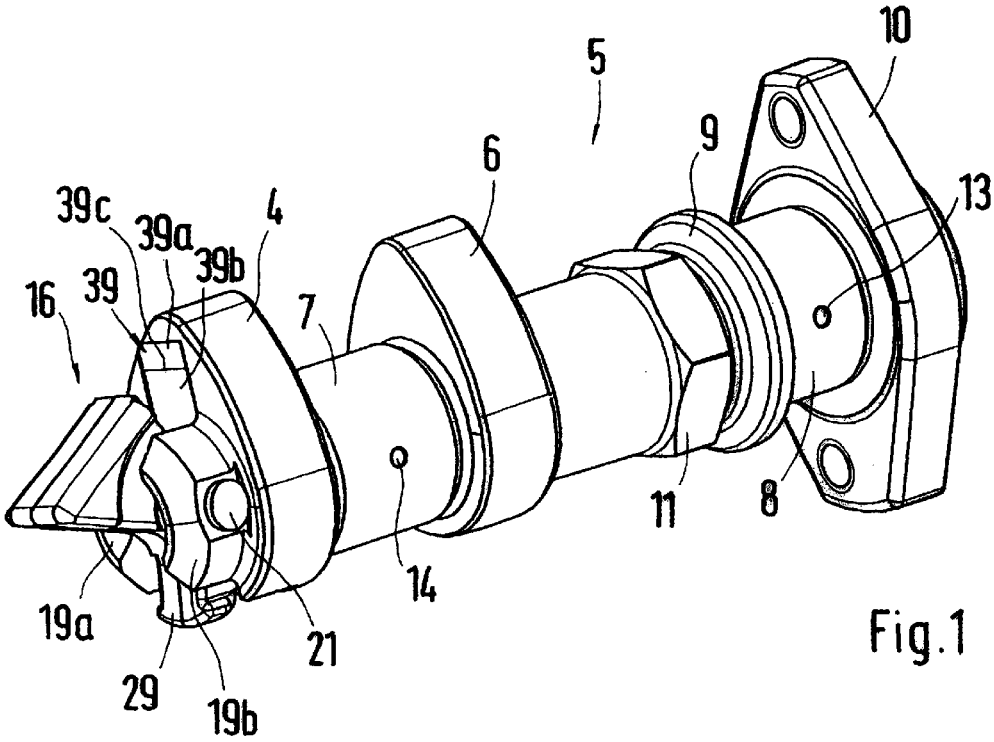
FIG. 1 is a perspective view of a camshaft and decompression lever assembly embodying the invention.
Figure 2:
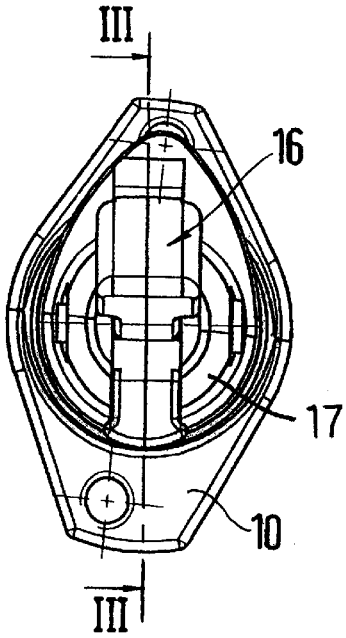
FIG. 2 is an end view of the camshaft and decompression lever assembly of FIG. 1.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENT

Figure 3:
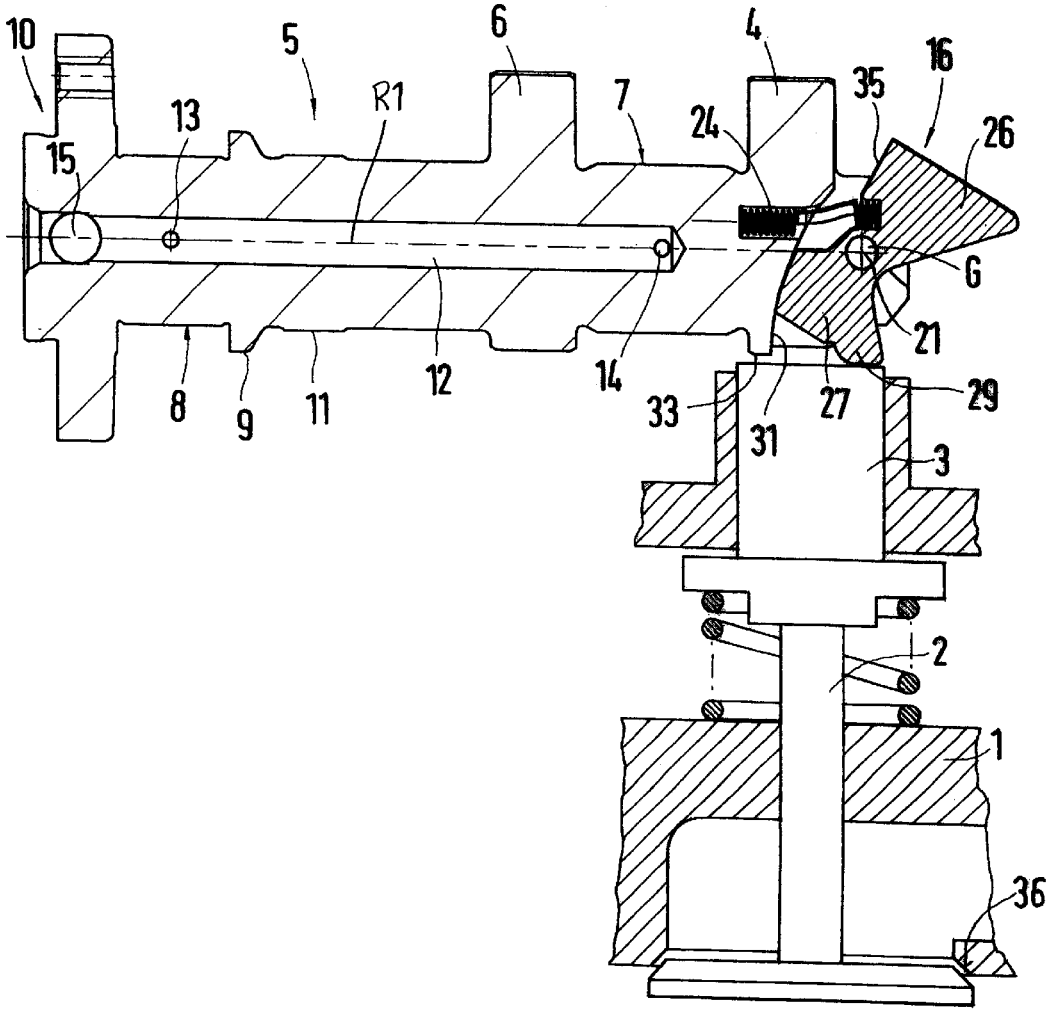
FIG. 3 is a section view of the camshaft and decompression lever assembly taken along line III—III in FIG. 2, and shown in conjunction with a valve.
Figure 12:
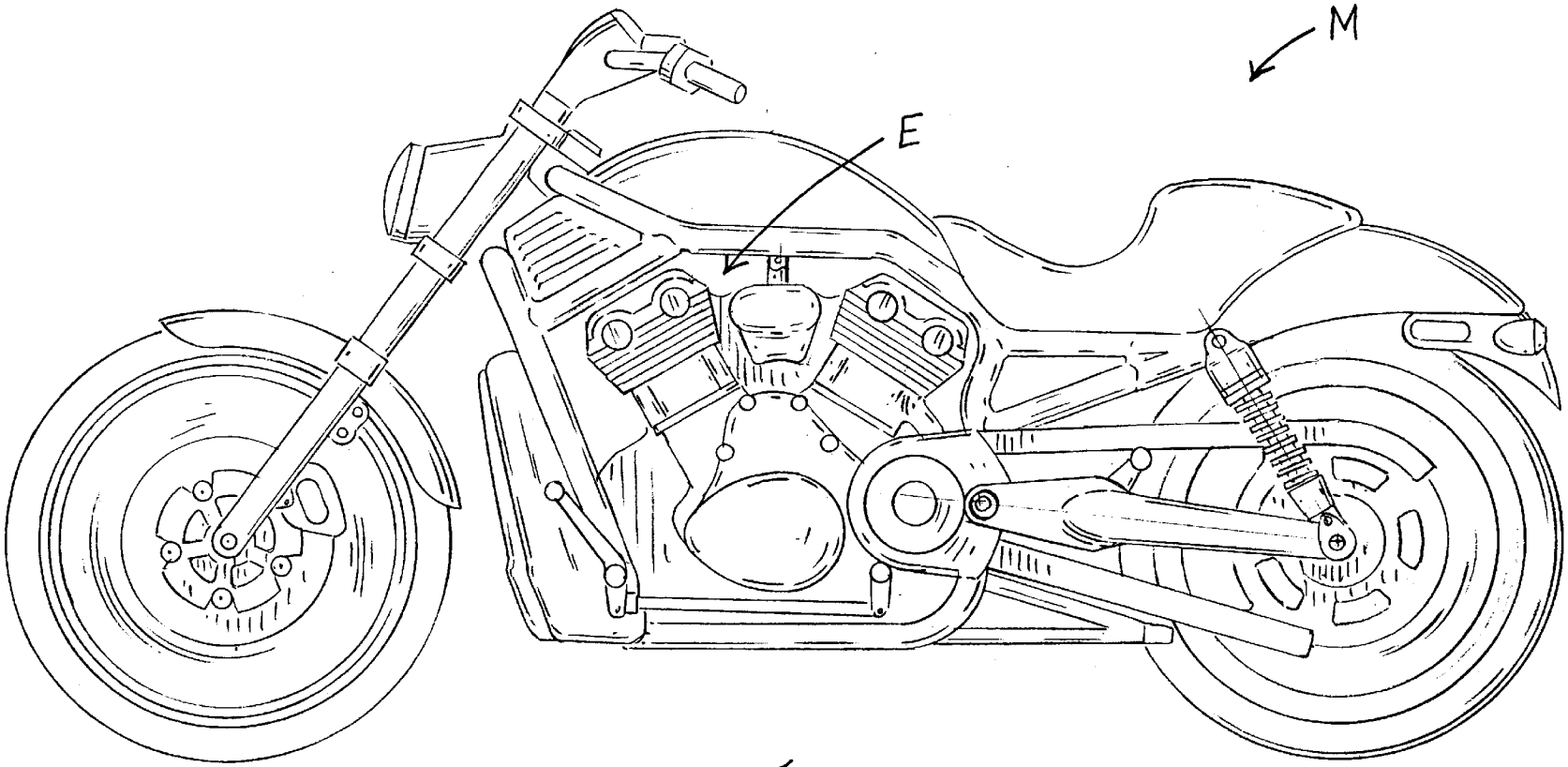
FIG. 12 is a perspective view of a motorcycle having an internal combustion engine embodying the invention.

Referring first to FIG. 3, a cylinder head 1 of an internal-combustion engine E (see FIG. 12) houses a gas-exchange valve 2. In the illustrated embodiment, the internal-combustion engine E is preferably the prime mover for a motorcycle M, however, other engine applications are also contemplated. The valve 2 is actuated in a known manner by way of a barrel tappet 3 that acts as an intermediary between a cam 4 and the valve 3. The cam 4 is mounted or integrally formed on a camshaft 5 having an axis of rotation R1. The camshaft 5 has a second cam 6 which actuates a second gas-exchange valve (not shown) in an identical manner to the cam 4.

As best seen in FIGS. 1 and 3, the camshaft 5 has a radial bearing 7 and an axial bearing 8 with a run-up collar 9. A fastening flange 10, to which a sprocket (not shown) for driving the camshaft 5 is fastened, adjoins the axial bearing 8. In addition, a hexagonal portion 11 for manual adjustment of the camshaft 5 is arranged between the cam 6 and the axial-bearing collar 9.

The camshaft 5 has an oil duct in the form of a bore 12 (see FIG. 3) that is connected to a radial bore 13 communicating with the axial bearing 8. The oil duct 12 also communicates with a radial bore 14 that communicates with the radial bearing 7. An oil-supply groove (not shown) is formed in a bearing stand (not shown) that supports the axial bearing 8 and supplies lubricating oil to the axial bearing 8. Lubricating oil is supplied to the radial bearing 7 by way of the bore 13, the oil duct 12, and the bore 14. The oil duct 12 is sealed off by a steel ball 15 adjacent the fastening flange 10.

Figure 10:
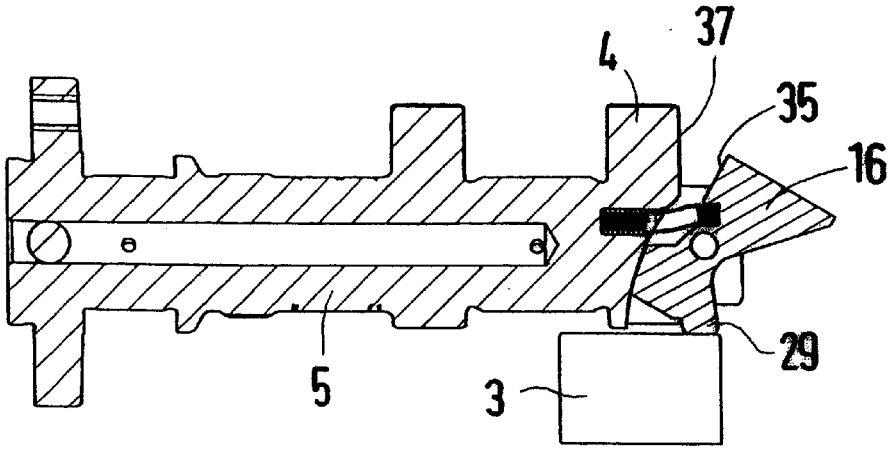
FIG. 10 shows the decompression lever in a first position.
Figure 11:
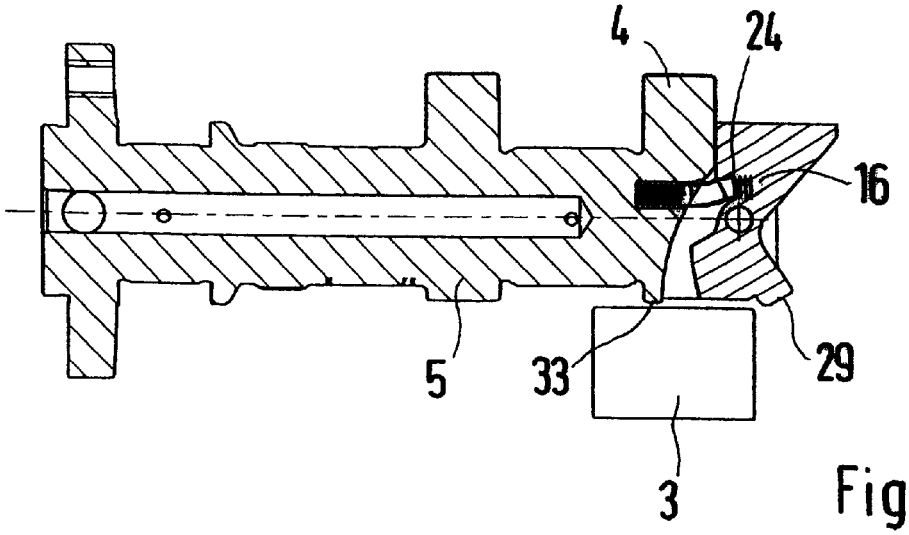
FIG. 11 shows the decompression lever in a second position.

A decompression lever 16 is pivotally mounted on an end face 17 of the camshaft 5, opposite the fastening flange 10. As will be described in detail below, the decompression lever 16 pivots between a first position (see FIGS. 3 and 10) and a second position (see FIG. 11) to selectively engage or disengage the barrel tappet 3 and the valve 2 during rotation of the camshaft 5.

Figure 9:
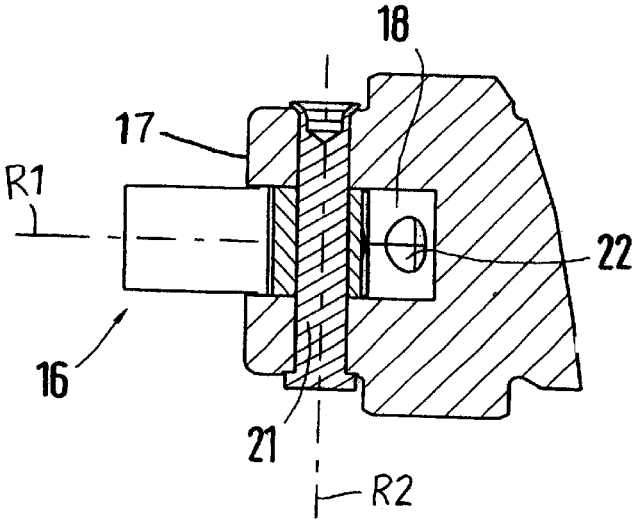
FIG. 9 is an enlarged portion Z of FIG. 8.

A slot or groove 18 (see FIG. 9), through which the camshaft 5 is subdivided into two bearing segments 19*a* and 19*b* (see FIG. 1), is milled in the end face 17 of the camshaft 5 in order to receive the decompression lever 16. The two bearing segments 19*a*, 19*b* and the decompression lever 16 are each provided with bores 20 for receiving a pin 21. The pin 21 pivotally supports the decompression lever 16 between the bearing segments 19*a*, 19*b*. When assembled, the axis of the bore 20 and the longitudinal axis R2 of the pin 21 are substantially perpendicular to the rotational axis R1 of the camshaft 5 (see FIG. 9).

Figure 6:
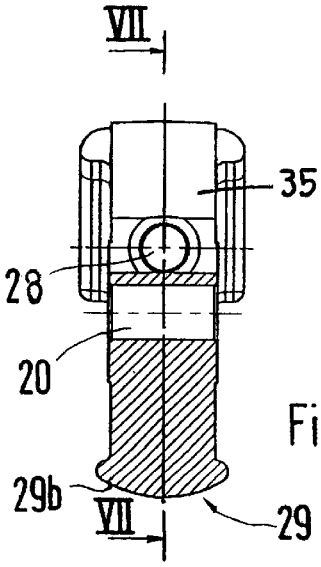
FIG. 6 is a section view taken along line VI—VI in FIG. 5.
Figure 7:
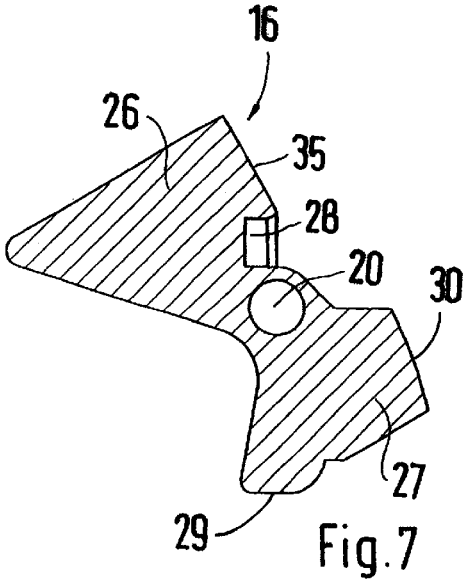
FIG. 7 is a section view taken along the line VII—VII in FIG. 6.
Figure 8:
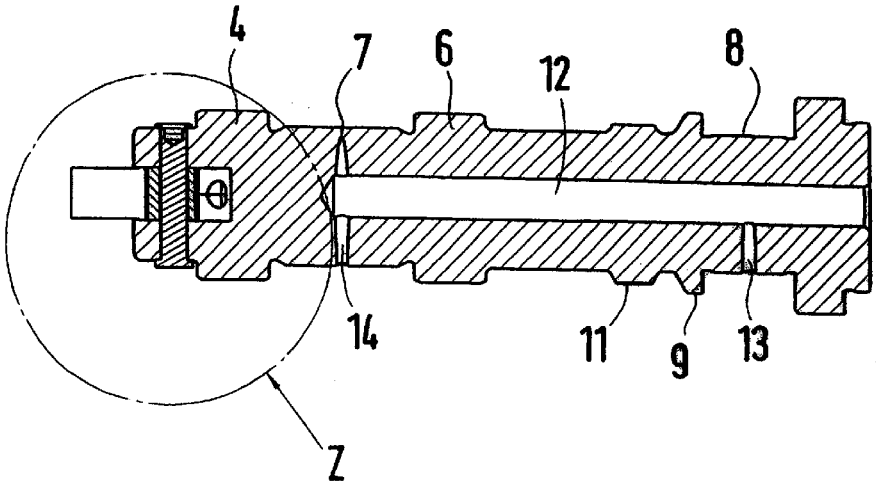
FIG. 8 is a longitudinal section through the camshaft.

An axially extending blind bore 22 (see FIG. 9) is formed in the slot 18. As shown in FIG. 3, the end of a spiral spring 24 is received in the blind bore 22. The decompression lever 16 represents a two-armed lever with respect to its rotational axis R2. The overall masses of the two lever arms 26 and 27 are arranged in such a way that the overall center of gravity G of the decompression lever 16 is situated in the fulcrum or on the rotational axis R2 of the decompression lever 16. As seen in FIGS. 6 and 7, the end face 35 of the lever arm 26 facing the cam 4 has a blind hole 28 in which the other end of the spiral spring 24 is received.

Figure 4:
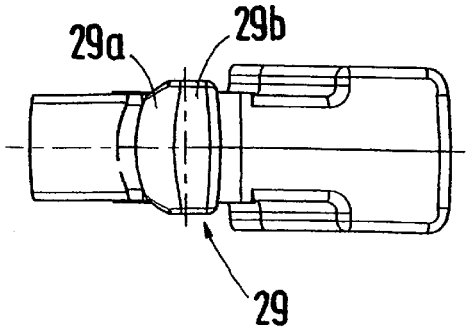
FIG. 4 is a top view of the decompression lever.
Figure 5:
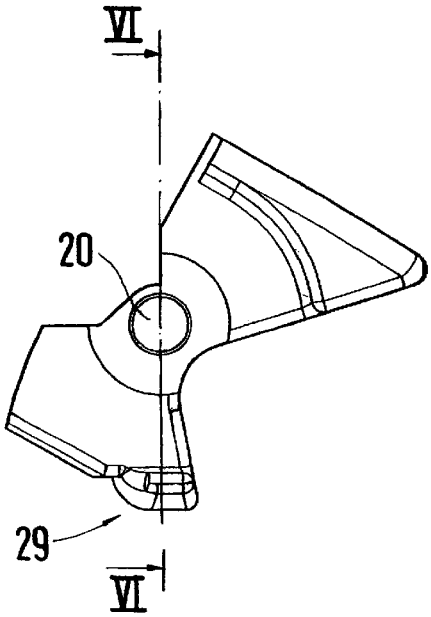
FIG. 5 is a side view of the decompression lever.

The lever arm 27 has a cam-like extension 29, which in the assembled state cooperates with the barrel tappet 3 by way of two partial faces 29*a* and 29*b* (see FIG. 4). The faces 29*a* and 29*b* are each provided with a radius of curvature. In addition, the lever arm 27 is provided with a curved lateral face 30 (see FIG. 7), which in the first position (see FIGS. 3 and 10), rests against an abutment face 31 (see FIG. 3) of the camshaft 5. The abutment face 31 is preferably provided with the same radius of curvature as the curved lateral face 30.

The dimensions of the cam-like extension 29 are such that when the decompression lever 16 is in the first position (see FIG. 3), the extension 29 projects beyond the base circle 33 of the cam 4, so that the cam-like extension 29 engages the barrel tappet 3 when the camshaft 5 rotates to lift the valve 2 off the valve seat 36.

In the second position of the decompression lever 16 (see FIG. 11) the end face 35 of the lever arm 26 rests against the end face 37 (see FIG. 10) of the cam 4. As shown in FIG. 1, a groove 39, the base of which comprises two partial faces 39*a* and 39*b* at an inclination with respect to each other, is formed in the end face 37 of the cam 4. An intersection line or stop 39*c* is formed by the intersection of the two partial faces 39*a* and 39*b*. In the second position the lateral face 35 of the lever arm 26 rests against the stop 39*c*. The line contact between the face 35 and the stop 39*c* prevents the decompression lever 16 from sticking to the end face 37 of the cam 4 during movement from the second position to the first position as a result of adhesion forces caused by oil and/or dirt.

In the second position, the cam-like extension 29 of the lever arm 27 is pivoted out of engaging relation with the barrel tappet 3 so that the barrel tappet 3 cooperates with the base circle 33 and the remaining portions of the cam 4. In other words, in the second position, the decompression lever 16 does not engage or contact the tappet 3 during rotation of the camshaft 5, and no automatic decompression occurs.

The operation of decompression lever 16 will now be described. As a result of the rotation of the camshaft 5, the decompression lever 16 is acted upon by centrifugal forces which let a torque—directed about the rotational axis R2 of the decompression lever 16 and counteracting the force of the spiral spring 24—act upon the decompression lever 16. At low rotational speeds (for example less than 500 RPM), the moment caused by the action of the spiral spring 24 is greater than the moment caused by the centrifugal forces so that the decompression lever 16 is biased into its first position, illustrated in FIGS. 3 and 10. In this first position, the cam-like extension 29 cooperates with the barrel tappet 3 to provide the automatic decompression of the cylinder.

As the rotational speed of the camshaft 5 increases, the torque acting upon the decompression lever 16 as a result of the centrifugal forces increases until the centrifugal force overcomes the bias created by the spiral spring 24. At this point, the decompression lever 16 pivots against the bias of the spiral spring 24. As the decompression lever 16 pivots toward the second position, the dynamic forces acting on the pivoted lever 16 change due to the changing orientation of the arms 26 and 27 to facilitate and complete the pivoting motion from the first position to the second position shown in FIG. 11.

If the decompression lever 16 is in its second position and if the lower shifting speed is reached, the dynamic relationship is altered in the reverse manner to pivot the decompression lever 16 back to the first position. As described above, sticking or adhesion between the lateral face 35 of the lever arm 26 and the end face 37 of the cam 4 is substantially eliminated due to the line contact between the lateral face 35 and the stop 39*c*.

Various features of the invention are set forth in the following claims.

What is claimed is:

1. An automatic decompression device for an internal combustion engine, the device comprising:

a camshaft rotatable about an axis of rotation and having an end face; and a lever coupled to the end face and movable between a first position, wherein the lever at least partially extends axially from the end face and is engageable with a valve actuating device to actuate a valve during rotation of the camshaft, and a second position, wherein the lever does not substantially move the valve actuating device.

2. The automatic decompression device of claim 1, wherein the lever is pivotally coupled to the end face.

3. The automatic decompression device of claim 2, wherein the lever pivots about a pivot axis that is substantially perpendicular to the axis of rotation of the camshaft.

4. The automatic decompression device of claim 2, wherein the lever pivots from the first position to the second position due to increased centrifugal force acting on the lever during rotation of the camshaft.

5. The automatic decompression device of claim 1, further including a spring between the end face and the lever to bias the lever toward the first position.

6. The automatic decompression device of claim 1, wherein the end face includes a slot and the lever is at least partially retained within the slot.

7. The automatic decompression device of claim 1, further including a cam mounted adjacent the end face of the camshaft, the cam having an end face that is engaged by the lever when the lever is in the second position.

8. The automatic decompression device of claim 7, wherein the end face of the cam includes a groove having therein a stop, and wherein the lever includes an arm that engages the stop when the lever is in the second position.

9. The automatic decompression device of claim 8, wherein the engagement between the stop and the arm is a line contact.

10. A motorcycle engine comprising:

a valve;

a valve actuating device coupled to the valve;

a camshaft mounted adjacent the valve actuating device for rotation about an axis of rotation, the camshaft having first and second axially outermost bearings and an end face positioned axially outside of the bearings; and a lever positioned axially outside the bearings, the lever being coupled to the end face and movable between a first position, wherein the lever is engageable with the valve actuating device to actuate the valve during rotation of the camshaft, and a second position, wherein the lever does not substantially move the valve actuating device.

11. The motorcycle engine of claim 10, wherein the lever is pivotally coupled to the end face.

12. The motorcycle engine of claim 11, wherein the lever pivots about a pivot axis that is substantially perpendicular to the axis of rotation of the camshaft.

13. The motorcycle engine of claim 11, wherein the lever pivots from the first position to the second position due to increased centrifugal force acting on the lever during rotation of the camshaft.

14. The motorcycle engine of claim 10, further including a spring between the end face and the lever to bias the lever toward the first position.

15. The motorcycle engine of claim 10, wherein the end face includes a slot and the lever is at least partially retained within the slot.

16. The motorcycle engine of claim 10, further including a cam mounted adjacent the end face of the camshaft, the cam having an end face that is engaged by the lever when the lever is in the second position.

17. The motorcycle engine of claim 16, wherein the end face of the cam includes a groove having therein a stop, and wherein the lever includes an arm that engages the stop when the lever is in the second position.

18. The motorcycle engine of claim 17, wherein the engagement between the stop and the arm is a line contact.

19. An automatic decompression device for a motorcycle engine, the device comprising:

a camshaft configured to be rotatable about an axis of rotation such that an end face of the camshaft is not directly supported by a bearing element;

a lever pivotally coupled to the end face and pivotable about a pivot axis that is substantially perpendicular to the axis of rotation of the camshaft, the lever being pivotable in response to varying magnitudes of centrifugal force between a first position, wherein the lever is engageable with a valve actuating device to actuate a valve during rotation of the camshaft, and a second position, wherein the lever does not substantially move the valve actuating device;

a spring between the end face and the lever to bias the lever toward the first position; and a cam mounted adjacent the end face of the camshaft, the cam having an end face defining a groove with a stop, and wherein the lever includes an arm that engages the stop via a line contact engagement when the lever is in the second position.

* * * * *